US010930228B2

(12) United States Patent
Tian et al.

(10) Patent No.: US 10,930,228 B2
(45) Date of Patent: Feb. 23, 2021

(54) DISPLAY DRIVING CIRCUIT AND DRIVING METHOD THEREOF, DISPLAY DEVICE

(71) Applicants: BOE TECHNOLOGY GROUP CO., LTD., Beijing (CN); Chongqing BOE Optoelectronics Technology Co., Ltd., Chongqing (CN)

(72) Inventors: Zhenguo Tian, Beijng (CN); Jingpeng Zhao, Beijing (CN); Taoliang Tang, Beijing (CN); Zhi Zhang, Beijing (CN); Heecheol Kim, Beijing (CN); Taeyup Min, Beijing (CN)

(73) Assignees: BOE TECHNOLOGY GROUP CO., LTD., Beijing (CN); Chongqing BOE Optoelectronics Technology Co., Ltd., Chongqing (CN)

( * ) Notice: Subject to any disclaimer, the term of this patent is extended or adjusted under 35 U.S.C. 154(b) by 298 days.

(21) Appl. No.: 16/049,611

(22) Filed: Jul. 30, 2018

(65) Prior Publication Data

US 2019/0051256 A1 Feb. 14, 2019

(30) Foreign Application Priority Data

Aug. 11, 2017 (CN) ..... 2017 1 0691061

(51) Int. Cl.
*G09G 3/36* (2006.01)

(52) U.S. Cl.
CPC ..... *G09G 3/3607* (2013.01); *G09G 2310/027* (2013.01); *G09G 2310/0264* (2013.01); *G09G 2310/0291* (2013.01); *G09G 2310/08* (2013.01)

(58) Field of Classification Search
None
See application file for complete search history.

(56) References Cited

U.S. PATENT DOCUMENTS 7,750,900 B2 * 7/2010 Tsuchi ..... G09G 3/3688 345/210
2007/0188430 A1 8/2007 Moon
(Continued)

FOREIGN PATENT DOCUMENTS

CN 1614679 A 5/2005
CN 101022005 A 8/2007
(Continued)

OTHER PUBLICATIONS

First Office Action issued in corresponding Chinese Patent Application No. 201710691061.0, dated Mar. 4, 2019; with English translation.

*Primary Examiner* — Krishna P Neupane
(74) *Attorney, Agent, or Firm* — McDermott Will & Emery LLP

(57) ABSTRACT

A display driving circuit, a driving method thereof, and a display device are provided. The display driving circuit includes: a timing controller which is configured to acquire grayscale data of subpixels in a frame of display image row by row and output the grayscale data to the grayscale controller; a grayscale controller which is configured to receive grayscale data of each subpixel in each row of subpixels, and control at least a part of the plurality of reference grayscale voltage output terminals in the grayscale controller to output reference grayscale voltages according to the grayscale data of each subpixel in each row of subpixels; a source IC which is configured to generate a grayscale voltage according to the received reference grayscale voltages and input the grayscale voltage as a data voltage to a data line.

14 Claims, 6 Drawing Sheets

(56) References Cited

U.S. PATENT DOCUMENTS

| | | | | |
|---|---|---|---|---|
| 2007/0247408 | A1* | 10/2007 | Nishimura | G09G 3/3666 345/89 |
| 2008/0062111 | A1 | 3/2008 | Chang et al. | |
| 2009/0096819 | A1 | 4/2009 | Kinoshita | |
| 2009/0153533 | A1* | 6/2009 | Umeda | G09G 3/3688 345/204 |
| 2010/0295861 | A1* | 11/2010 | Somerville | G09G 3/3216 345/545 |
| 2012/0120067 | A1* | 5/2012 | Kim | G09G 3/3688 345/419 |

FOREIGN PATENT DOCUMENTS

| | | | |
|---|---|---|---|
| CN | 101145323 | A | 3/2008 |
| CN | 101414447 | A | 4/2009 |
| CN | 101894529 | A | 11/2010 |

* cited by examiner

DISPLAY DRIVING CIRCUIT AND DRIVING METHOD THEREOF, DISPLAY DEVICE

This application claims priority to Chinese Patent Application No. 201710691061.0, filed on Aug. 11, 2017, titled "A DISPLAY DRIVING CIRCUIT AND DRIVING METHOD THEREOF, DISPLAY DEVICE", which is incorporated herein by reference in its entirety.

TECHNICAL FIELD

The present disclosure relates to the field of display technologies, and in particular, to a display driving circuit, a method for driving the display driving circuit, and a display device.

BACKGROUND

As a flat panel display device, a thin film transistor liquid crystal display (TFT-LCD) is increasingly used in the high-performance display field due to its small size, low power consumption, no radiation and relatively low production cost.

SUMMARY

In a first aspect, there is provided a display driving circuit comprising a timing controller, a grayscale controller and a source integrated circuit (source IC); the timing controller is connected with the grayscale controller and the source IC, and the timing controller is configured to acquire grayscale data of subpixels in a frame of display image row by row and output the grayscale data to the grayscale controller; the grayscale controller has a plurality of reference grayscale voltage output terminals corresponding to each subpixel in each row of subpixels; the grayscale controller is configured to receive grayscale data of each row of subpixels row by row, and control at least a part of reference grayscale voltage output terminals of the plurality of reference grayscale voltage output terminals to output reference grayscale voltages according to the grayscale data of each subpixel in each row of subpixels; the source IC is also connected with the plurality of reference grayscale voltage output terminals; the source IC is configured to generate a grayscale voltage corresponding to each subpixel in each row of subpixels according to the received reference grayscale voltages under the control of a timing signal, and input the grayscale voltage as a data voltage to a data line connected to each subpixel in each row of subpixels.

In some embodiments of the present disclosure, the grayscale data is composed of multi-bit binary numbers, and each bit of the multi-bit binary numbers corresponds to one reference grayscale voltage output terminal of the plurality of reference grayscale voltage output terminals, so as to make the one reference grayscale voltage output terminal output or stop outputting a reference grayscale voltage to the source IC.

In some embodiments of the present disclosure, the grayscale controller comprises multiple sets of reference grayscale voltage output terminals; each set of reference grayscale voltage output terminals of the multiple sets of reference grayscale voltage output terminals comprises the plurality of reference grayscale voltage output terminals; and each set of reference grayscale voltage output terminals corresponds to a column of subpixels.

In some embodiments of the present disclosure, the grayscale controller comprises: a set of reference grayscale voltage output terminals, wherein the set of reference grayscale voltage output terminals comprises the plurality of reference grayscale voltage output terminals; multiple sets of access switches, wherein each set of access switches of the multiple sets of access switches corresponds to a column of subpixels, and each set of access switches comprises a plurality of access switches, and each access switch of the plurality of access switches is connected to the plurality of reference grayscale voltage output terminals in one-to-one correspondence.

In some embodiments of the present disclosure, the timing controller is connected to the grayscale controller through a serial interface; the grayscale controller comprises a serial-to-parallel module and a plurality of grayscale voltage generation modules; the serial-to-parallel module is connected to the serial interface, and the serial-to-parallel module is configured to convert serial data input from the serial interface into a plurality of parallel data and output the plurality of parallel data to a plurality of enable signal output terminals of the serial-to-parallel module respectively; each of the grayscale voltage generation modules is connected to one enable signal output terminal of the serial-to-parallel module; each of the grayscale voltage generation modules is configured to generate a reference grayscale voltage according to preset parameters under the control of one enable signal output terminal of the plurality of enable signal output terminals.

In some embodiments of the present disclosure, an output terminal of each of the grayscale voltage generation modules is formed as one reference grayscale voltage output terminal.

In some embodiments of the present disclosure, the source IC comprises a plurality of driving channels that are in one-to-one correspondence with a plurality of data lines, and a digital-to-analog converter and an operational amplifier are disposed in each driving channel; the digital-to-analog converter is connected with the plurality of reference grayscale voltage output terminals of the grayscale controller, and the digital-to-analog converter is configured to be able to generate at least one grayscale voltage according to the reference grayscale voltages output by the plurality of reference grayscale voltage output terminals; the at least one grayscale voltage is an analog voltage; the operational amplifier is connected with the digital-to-analog converter and a data line, and the operational amplifier is configured to amplify the analog voltage output by the digital-to-analog converter so as to output the analog voltage as a data voltage to the data line.

In some embodiments of the present disclosure, the digital-to-analog converter is configured to have the capability of generating at least one grayscale voltage, and generate only one grayscale voltage corresponding to one data line at a specific time.

In some embodiments of the present disclosure, the digital-to-analog converter comprises a plurality of voltage-dividing resistors connected in series and a plurality of control switch groups that are cascaded and connected with the voltage-dividing resistors; each control switch group comprises a plurality of control switches connected in parallel; each of the control switches is connected to the timing controller, and the timing controller is configured to control an on and off of each of the control switches.

In some embodiments of the present disclosure, a part of reference grayscale voltage output terminals of the plurality of reference grayscale voltage output terminals are located in a first output terminal group, and another part of the reference grayscale voltage output terminals are located in a second output terminal group; the reference grayscale voltages output by the reference grayscale voltage output terminals in the first output terminal group have a positive polarity; the reference grayscale voltages output by the reference grayscale voltage output terminals in the second output terminal group have a negative polarity; wherein, the numbers of reference grayscale voltage output terminals in the first output terminal group and in the second output terminal group are equal.

In some embodiments of the present disclosure, the display driving circuit further comprises an image processor connected to the timing controller; the image processor is configured to store multiple successive frames of display images.

In some embodiments of the present disclosure, the image processor is further configured to output the grayscale data of each subpixel in each frame of display image to the timing controller one by one.

In another aspect, there is provided a display device comprising any of the display driving circuits described above.

In another aspect, there is provided a method for driving any of the display driving circuits described above. The method comprises: the timing controller acquiring the grayscale data of the subpixels in one frame of display image row by row and outputting the grayscale data to the grayscale controller; the grayscale controller receiving the grayscale data of each subpixel in each row of subpixels, and controlling at least a part of reference grayscale voltage output terminals of the plurality of reference grayscale voltage output terminals in the grayscale controller to output reference grayscale voltages according to the grayscale data of each subpixel in each row of subpixels; the timing controller outputting a timing signal to the source IC; the source IC generating a grayscale voltage corresponding to each subpixel in each row of subpixels according to the received reference grayscale voltages under the control of the timing signal, and inputting the grayscale voltage as a data voltage to a data line connected to each subpixel in each row of subpixels.

In some embodiments of the present disclosure, in the case where the timing controller is connected to the grayscale controller through a serial interface, and the grayscale controller comprises a serial-to-parallel module and a plurality of grayscale voltage generation modules, "the grayscale controller controlling at least a part of reference grayscale voltage output terminals of the plurality of reference grayscale voltage output terminals in the grayscale controller to output reference grayscale voltages according to the grayscale data of each subpixel in each row of subpixels" comprises: the serial-to-parallel module converting serial data input from the serial interface into a plurality of parallel data and outputting the plurality of parallel data to a plurality of enable signal output terminals of the serial-to-parallel module respectively; the grayscale voltage generation modules generating a reference grayscale voltage according to preset parameters under the control of the enable signal output terminal.

In some embodiments of the present disclosure, in the case where the source IC comprises a plurality of driving channels that are in one-to-one correspondence with a plurality of data lines, and a digital-to-analog converter and an operational amplifier are disposed in each driving channel, the source IC "generating a grayscale voltage corresponding to each subpixel in each row of subpixels according to the received reference grayscale voltages, and inputting the grayscale voltage as a data voltage to a data line connected to each subpixel in each row of subpixels" under the control of the timing signal comprises: the digital-to-analog converter generating at least one grayscale voltage according to the reference grayscale voltages output by the reference grayscale voltage output terminals; the at least one grayscale voltage is an analog voltage; the operational amplifier amplifying the analog voltage output by the digital-to-analog converter so as to output the analog voltage as a data voltage to the data line.

In yet another aspect, there is provided a computer non-transitory readable storage medium. The computer non-transitory readable storage medium stores computer instructions, and the computer instructions are configured to perform a method of driving the display driving circuit.

In yet another aspect, there is provided a computer program product. The computer program product comprises instructions that, when run on a computer, cause a computer to perform a method of driving the display driving circuit.

In yet another aspect, there is provided a computer program. When loaded onto a processor, the computer program causes the processor to perform a method of driving the display driving circuit.

DETAILED DESCRIPTION

The technical solutions in the embodiments of the present disclosure will be described clearly and completely below with reference to the accompanying drawings in the embodiments of the present disclosure. Obviously, the described embodiments are merely some but not all of embodiments of the present disclosure. All other embodiments made on the basis of the embodiments of the present disclosure by a person of ordinary skill in the art without paying any creative effort shall be included in the protection scope of the present disclosure.

TFT-LCD includes horizontal and vertical staggered gate lines and data lines. In the display process, the gate lines are scanned line by line, so as to gate the subpixels in the TFT-LCD row by row; then, data voltages are input to the gated row of subpixels via the data lines, so as to charge the gated row of subpixels. At this time, liquid crystal molecules corresponding to the gated row of subpixels are deflected, so that the grayscale value displayed by the gated row of subpixels matches with the grayscale value output to the gated row of subpixels.

Figure 1:
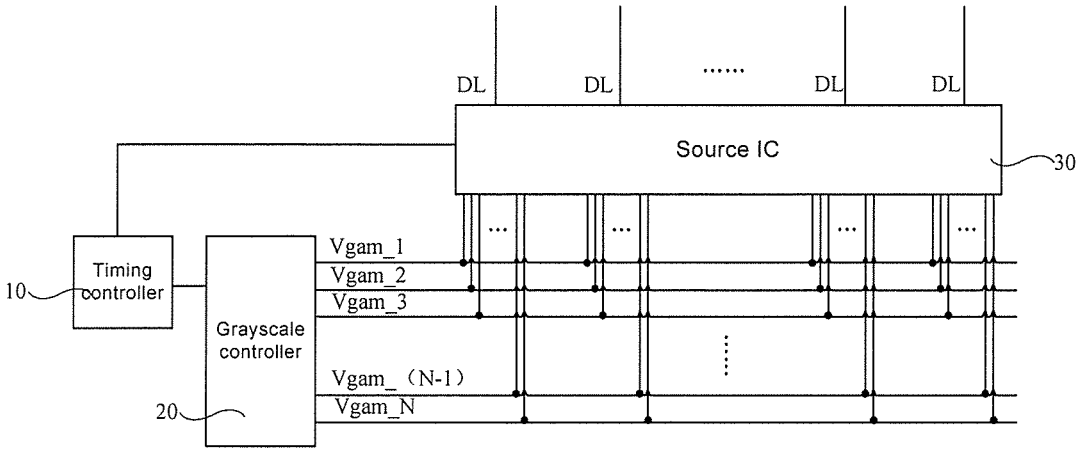
FIG. 1 is a schematic structural diagram of a display driving circuit provided by some embodiments of the present disclosure.

In general, a source IC (Source Integrated Circuit) for outputting data voltages to the data lines is provided in the TFT-LCD. With the continuous improvement of TFT-LCD resolution and refresh rate, there is a higher requirement for a computing power of the source IC, which makes the source IC work to the limit, and then causing an increase in the power consumption of the source IC and in turn severe heat in the source IC. Some embodiments of the present disclosure provide a display driving circuit, as shown in FIG. 1, comprising a timing controller (Tcon) 10, a grayscale controller 20, and a source IC 30.

The timing controller 10 is connected to the grayscale controller 20 and the source IC 30. The timing controller 10 is configured to acquire grayscale data of the subpixels in a frame of display image row by row and output the grayscale data to the grayscale controller 20. In addition, the timing controller 10 is also configured to output a timing signal to the source IC 30.

It will be noted that a display device having the above display driving circuit has subpixels arranged in a matrix in a display area thereof. The grayscale data of subpixels acquired by the timing controller 10 is a digital signal.

The above-mentioned grayscale controller 20 has a plurality of reference grayscale voltage output terminals (G1, G2, G3 . . . GN) corresponding to each subpixel in each row of subpixels. The plurality of reference grayscale voltage output terminals (G1, G2, G3 . . . GN) each can output a reference grayscale voltage (Vgam_1, Vgam_2, Vgam_3 . . . Vgam_N) respectively. The grayscale controller 20 is configured to receive grayscale data of each row of subpixels row by row, and control at least a part of reference grayscale voltage output terminals (e.g., G1, G2, G3) of the plurality of reference grayscale voltage output terminals to output reference grayscale voltages (Vgam_1, Vgam_2, Vgam_3) according to the grayscale data of each subpixel in each row of subpixels. N is a positive integer greater than or equal to 2.

Based on this, the above-mentioned source IC 30 is also connected to the plurality of reference grayscale voltage output terminals (G1, G2, G3 . . . GN). The source IC 30 is configured to generate a grayscale voltage corresponding to each subpixel in each row of subpixels according to the received reference grayscale voltages (Vgam_1, Vgam_2, Vgam_3 . . . Vgam_N) under the control of a timing signal output by the timing controller 10, and transmit the grayscale voltage as a data voltage (Vdata) in the form of an analog voltage to a data line DL connected to each subpixel in each row of subpixels.

A plurality of grayscale voltages applied to each row of subpixels may be generated by the source IC 30 according to the plurality of reference grayscale voltages mentioned above. That is, each grayscale voltage corresponds to a subpixel in a row of subpixels, and each grayscale voltage corresponds to a grayscale value. Take it as an example that a display device provided with the above display driving circuit is capable of displaying 256 grayscales, the source IC 30 may generate 256 grayscale voltages according to the plurality of reference grayscale voltages mentioned above, and the 256 grayscale voltages may correspond to 256 grayscale values respectively. Alternatively, the source IC 30 may generate 64 grayscale voltages according to the plurality of reference grayscale voltages mentioned above, and the 64 grayscale voltages may correspond to 64 grayscale values respectively.

In addition, in some embodiments of the present disclosure, the number of reference grayscale voltages that the grayscale controller 20 can output is not limited. For example, the number of reference grayscale voltage output terminals may be 8, that is, G1, G2, and G3 . . . G8. At this time, the grayscale data received by the grayscale controller 20 is an 8-bit binary number, and each bit of the binary number corresponds to a reference grayscale voltage output terminal, so as to make one reference grayscale voltage output terminal output a reference grayscale voltage to the source IC 30, or stop outputting a reference grayscale voltage to the source IC 30.

Alternatively, in order to make the data voltage (Vdata) input to the data line DL able to invert a polarity of a liquid crystal layer in the above-mentioned display device, in some embodiments of the present disclosure, the number of reference grayscale voltage output terminals may be increased. For example, the number of reference grayscale voltage output terminals may be 16. Exemplarily, the 16 reference grayscale voltage output terminals are: G1, G2, G3, G4, G5, G6, G7, G8, G9, G10, G11, G12, G13, G14, G15, and G16. Among them, G15 and G16 in the 16 grayscale voltage output terminals may not be used. When only 14 grayscale voltage output terminals are used, the 14 reference grayscale voltage output terminals output the following reference grayscale voltages respectively: Vgam_1, Vgam_2, Vgam_3, Vgam_4, Vgam_5, Vgam_6, Vgam_7, Vgam_8, Vgam_9, Vgam_10, Vgam_11, Vgam_12, Vgam_13, and Vgam_14. At this time, the grayscale data received by the grayscale controller 20 is a 16-bit binary number, and each bit of the binary number corresponds to a reference grayscale voltage output terminal, so as to make one reference grayscale voltage output terminal output a reference grayscale voltage to the source IC 30, or stop outputting a reference grayscale voltage to the source IC 30. The bits of the binary number corresponding to the grayscale voltage output terminals G15 and G16 in the 16-bit binary number may not control the output of the grayscale controller 20.

For example, when one bit of the binary number in the 8-bit binary number or the 16-bit binary number is "1", the reference grayscale voltage output terminal corresponding to the bit of the binary number may be controlled to output a reference grayscale voltage to the source IC 30. On the contrary, when one bit of the binary number in the 8-bit binary number or 16-bit binary number is "0", the reference grayscale voltage output terminal corresponding to the bit of the binary number may be controlled to stop outputting a reference grayscale voltage to the source IC 30.

In this case, a part of the plurality of reference grayscale voltage output terminals (e.g., G1, G2, G3, G4, G5, G6, G7) is located in a first output terminal group, and another part of the plurality of reference grayscale voltage output terminals (e.g., G8, G9, G10, G11, G12, G13, G14) is located in a second output terminal group. The numbers of reference grayscale voltage output terminals in the first output terminal group and the second output terminal group are equal.

Based on this, the reference grayscale voltages (Vgam_1, Vgam_2, Vgam_3, Vgam_4, Vgam_5, Vgam_6, Vgam_7) output by the reference grayscale voltage output terminals (e.g., G1, G2, G3, G4, G5, G6, G7) in the first output terminal group have a positive polarity, and the reference grayscale voltages (Vgam_8, Vgam_9, Vgam_10, Vgam_11, Vgam_12, Vgam_13, Vgam_14) output by the reference grayscale voltage output terminals (e.g., G8, G9, G10, G11, G12, G13, G14) in the second output terminal group have a negative polarity. At this time, the data voltage (Vdata) input to the data line can be inverted in polarity as needed, so that the aging of liquid crystal molecules in the liquid crystal layer can be prevented.

In this case, take it as an example that the grayscale controller 20 has 16 reference grayscale voltage output terminals (G1, G2, G3, G4, G5, G6, G7, G8, G9, G10, G11, G12, G13, G14, G15 and G16, wherein G15 and G16 are not used), the combinations of on and off of the 16 reference grayscale voltage output terminals are shown in Table 1.

TABLE 1

| 4-digit hexadecimal number | 16-bit binary grayscale data | Combination of reference grayscale voltage output terminals |
|---|---|---|
| 0000H | 0000 0000 0000 0000 | No output at any one reference grayscale voltage output terminal |
| 0001H | 0000 0000 0000 0001 | G1 has an output, and the rest of the reference grayscale voltage terminals have no output |
| 0002H | 0000 0000 0000 0010 | G2 has an output, and the rest of the reference grayscale voltage terminals have no output |
| 0003H | 0000 0000 0000 0011 | G1 and G2 have outputs, and the rest of the reference grayscale voltage terminals have no output |
| 0004H | 0000 0000 0000 0100 | G3 has output, and the rest of the reference grayscale voltage terminals have no output |
| . . . | . . . | . . . |
| . . . | . . . | . . . |
| 3FFEH | 0011 1111 1111 1110 | G2, G3, G4, G5, G6, G7, G8, G9, G10, G11, G12, G13, G14 have outputs, and G1 has no output |
| 3FFFH | 0011 1111 1111 1111 | G1, G2, G3, G4, G5, G6, G7, G8, G9, G10, G11, G12, G13, G14 all have outputs |

As can be seen from Table 1, for example, when the 16-bit binary grayscale data received by the grayscale controller 20 is 0002H (as 16-bit binary numbers are too long, 4-digit hexadecimal numbers are used instead), the binary number corresponding to the reference grayscale voltage output terminal G2 of the grayscale controller 20 is "1", therefore the reference grayscale voltage output terminal G2 outputs a reference grayscale voltage Vgam_2; the binary numbers corresponding to the other reference grayscale voltage output terminals are all "0", therefore the other reference grayscale voltage output terminals all stop outputting reference grayscale voltages. Alternatively, based on the same principle, when the 16-bit binary grayscale data received by the grayscale controller 20 is 0003H, the reference grayscale voltage output terminals G1 and G2 of the grayscale controller 20 output the reference grayscale voltages Vgam_1 and Vgam_2 respectively.

As can be seen from the largest 4-digit hexadecimal grayscale data 3FFFH, there are 16,384 (16,384=(3FFFH+1)=4000H=$16^4$×3) combinations of the on and off of the reference grayscale voltage output terminals.

Figure 2:
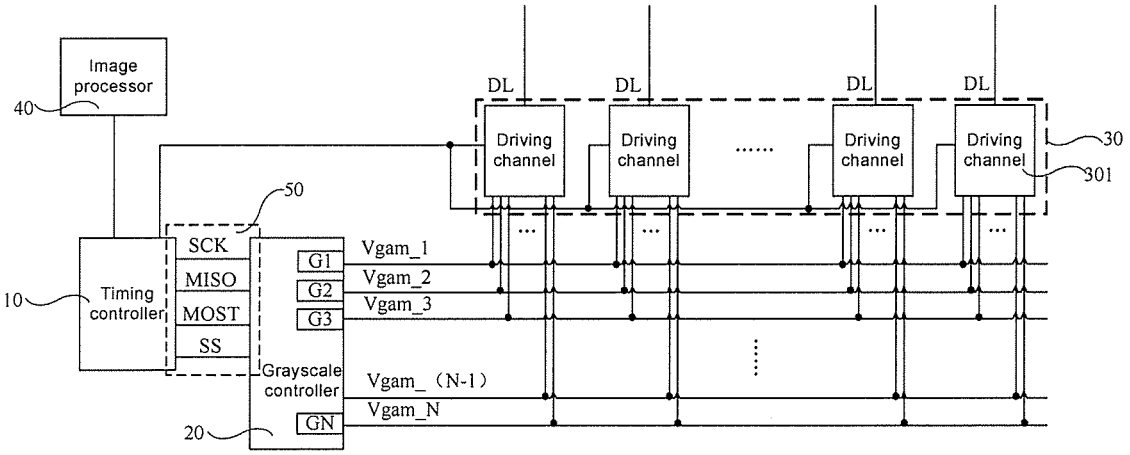
FIG. 2 is a schematic structural diagram of another display driving circuit provided by some embodiments of the present disclosure.

In some embodiments of the present disclosure, as shown in FIG. 2, the display driving circuit further includes an image processor 40 connected with the timing controller 10. The image processor 40 is configured to store multiple successive frames of display images. In this case, grayscale data of each subpixel in each frame of display image is also stored in the image processor 40. Based on this, when the timing controller 10 is connected with the graphic processor 40, the image processor 40 will output the grayscale data of each subpixel in each frame of display image to the timing controller 10 one by one, thereby enabling the timing controller 10 to acquire the grayscale data of subpixels in a frame of display image row by row.

Figure 3:
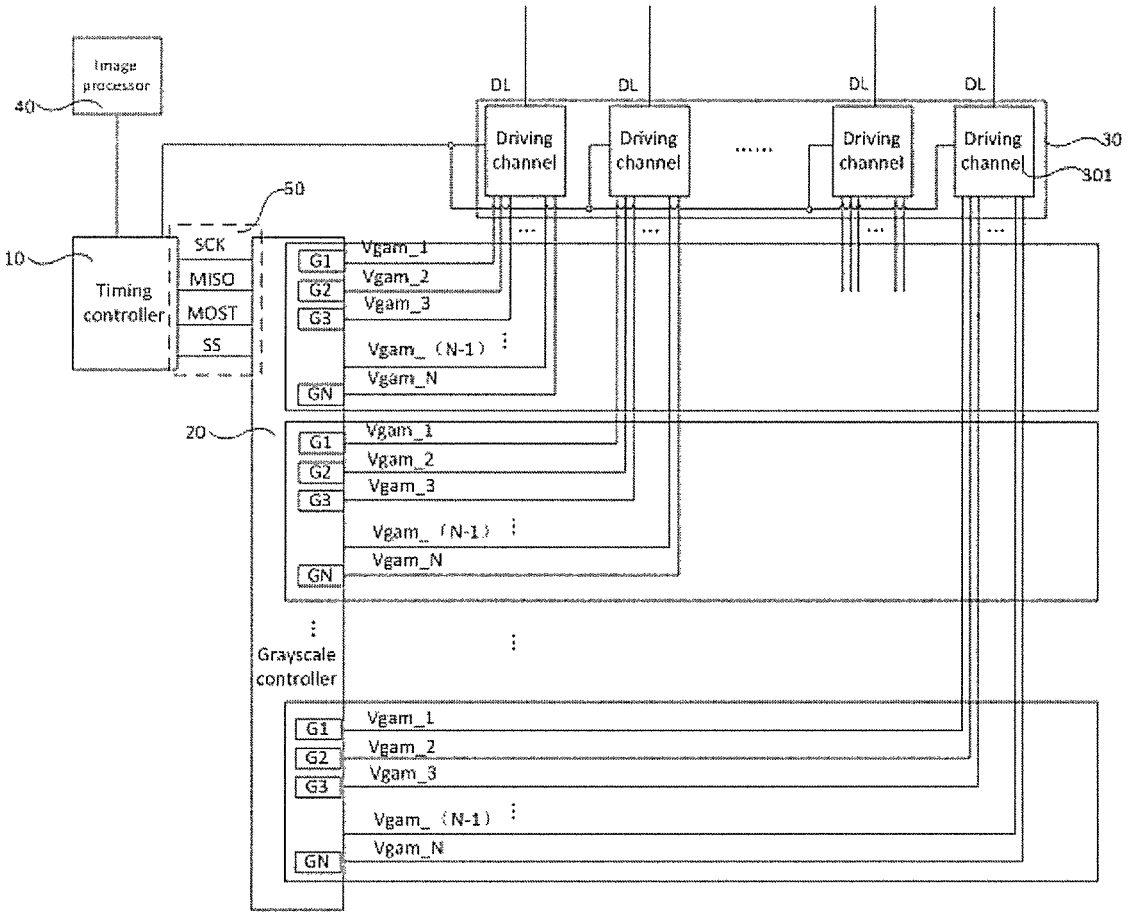
FIG. 3 is a schematic structural diagram of yet another display driving circuit provided by some embodiments of the present disclosure.

In some embodiments of the present disclosure, as shown in FIG. 3, the grayscale controller 20 includes multiple sets of reference grayscale voltage output terminals, and each set of reference grayscale voltage output terminals of the multiple sets of reference grayscale voltage output terminals includes a plurality of reference grayscale voltage output terminals G1, G2 . . . GN. In addition, each set of reference grayscale voltage output terminals corresponds to a column of subpixels. That is, for a row of subpixels, each set of reference grayscale voltage output terminals corresponds to one subpixel in the row of subpixels. In this way, each set of reference grayscale voltage output terminals can independently output a plurality of reference grayscale voltages corresponding to a column of subpixels to the source IC 30 without interference from the reference grayscale voltages required by other columns of subpixels. After receiving the plurality of reference grayscale voltages corresponding to the column of subpixels, the source IC 30 can generate a grayscale voltage corresponding to the column of subpixels under the control of the timing signal.

Figure 4:
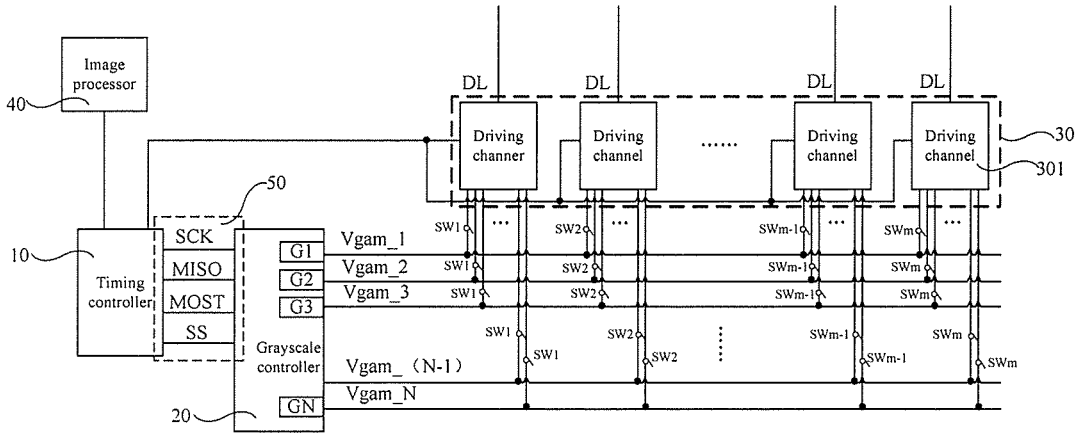
FIG. 4 is a schematic structural diagram of yet another display driving circuit provided by some embodiments of the disclosure.

In some embodiments of the present disclosure, as shown in FIG. 4, the grayscale controller 20 includes a set of reference grayscale voltage output terminals and multiple sets of access switches SW1, SW2 . . . SWm connected with the set of reference grayscale voltage output terminals. The set of reference grayscale voltage output terminals includes a plurality of reference grayscale voltage output terminals G1, G2 . . . GN. Each set of access switches in the multiple sets of access switches SW1, SW2 . . . SWm corresponds to a column of subpixels. Each set of access switches includes a plurality of access switches, and each access switch of the plurality of access switches is connected to the plurality of reference grayscale voltage output terminals in one-to-one correspondence. This allows each column of subpixels to multiplex one set of reference grayscale voltage output terminals, i.e., for a row of subpixels, each subpixel in the row of subpixels multiplexes one set of reference grayscale voltage output terminals. In the structure shown in FIG. 4, the set of reference grayscale voltage output terminals can independently output a plurality of reference grayscale voltages corresponding to a column of subpixels to the source IC 30 without interference from the reference grayscale voltages required by other columns of subpixels. In addition, the use of other sets of reference grayscale voltage output terminals is also avoided, and the hardware structure is simplified.

It will be noted that a plurality of data lines DL as shown in FIG. 1 are disposed in a display area of the display device having the above display driving circuit. Each data line DL is connected to the source IC 30, so that the data voltage (Vdata) output by the source IC 30 can be received. In addition, gate lines GL (not shown) are also provided in the display area to intersect with the data lines DL. The data lines DL and the gate lines GL intersect to define the above subpixels. When a row of subpixels is gated by a gate line GL that has received the gate driving signal, the row of subpixels may receive the data voltage (Vdata) on the data line DL through the data line DL. At this time, the row of subpixels is charged, and the liquid crystal molecules corresponding to the row of subpixels are deflected, so that the grayscale value displayed by the row of subpixels matches with the data voltage (Vdata) input to the row of subpixels.

As can be seen from the above, the grayscale controller 20 can receive the grayscale data of a row of subpixels from the timing controller 10 and control at least a part of reference grayscale voltage output terminals (e.g., G1, G2, G3) to output reference grayscale voltages (Vgam_1, Vgam_2, Vgam_3) according to the grayscale data, so that the part of reference grayscale voltage output terminals can be selected to be combined to generate a corresponding grayscale voltage. Therefore, in the display process of the display device having the above-mentioned display driving circuit, in most cases (i.e., in the cases without full grayscale display), the plurality of reference grayscale voltage output terminals of the grayscale controller 20 are not all turned on, but are selectively turned on (that is, only a part but not all of the plurality of reference grayscale voltage output terminals are turned on) based on the grayscale data of a row of subpixels in a frame of display image. The reference grayscale voltage output terminals that are turned on input data to the source IC 30, and the reference grayscale voltage output terminals that are not turned on do not input data to the source IC 30.

In this way, on the one hand, the amount of data input by the grayscale controller 20 to the source IC 30 can be greatly reduced, therefore the requirement for a computing power of the source IC 30 is lowered, and the probability of the source IC 30 working to the limit is reduced. As a result, the purpose of reducing the power consumption of the source IC 30 is achieved. On the other hand, since the amount of data input by the grayscale controller 20 to the source IC 30 is greatly reduced, the power consumption of the source IC 30 is reduced automatically through the internal control of the display driving circuit, and there is no need to provide a heat sink for dissipating heat from the source IC 30. As a result, the problem of increased production cost due to the use of the heat sink is avoided.

The structures of the grayscale controller 20 and the source IC 30 will be described in detail below.

In some embodiments of the present disclosure, it can be seen from the above that 14 bits in the 16-bit binary grayscale data received by the grayscale controller 20 can respectively control 14 reference grayscale voltage output terminals of the grayscale controller 20. Therefore, the data for controlling the plurality of reference grayscale voltage output terminals of the grayscale controller 20 is parallel data.

In this case, in order to reduce the number of data interfaces (I/Os) between the timing controller 10 and the grayscale controller 20, in some embodiments of the present disclosure, as shown in FIG. 2, the timing controller 10 is connected to the grayscale controller 20 through a serial interface 50. In this way, the timing controller 10 can input serial data to the grayscale controller 20 through the serial interface 50, so as to achieve the purpose of reducing the number of data interfaces (I/Os) between the timing controller 10 and the grayscale controller 20.

In some embodiments, the serial interface 50 is a Serial Peripheral Interface (SPI), so that an SPI serial communication standard is adopted between the timing controller 10 and the grayscale controller 20. The SPI is a standard 4-wire system.

Exemplarily, as shown in FIG. 2, the above 4-wire system includes a Serial Clock (SCK) line, a Master Input/Slave Output (MISO) data line, a Master Output/Slave Input (MOST) data line and an active-low Slave Selection (SS) line. In this case, when the active-low Slave Selection (SS) is always set low, the timing controller 10 can input serial grayscale data to the grayscale controller 20 through the Master Output/Slave Input (MOST) data line. At this time, the grayscale controller 20 can always be in the receiving state. In addition, since the grayscale controller 20 does not need to input data to the timing controller 10 in some embodiments of the present disclosure, the above-described Master Input/Slave Output (MISO) data line may not be used.

Figure 5:
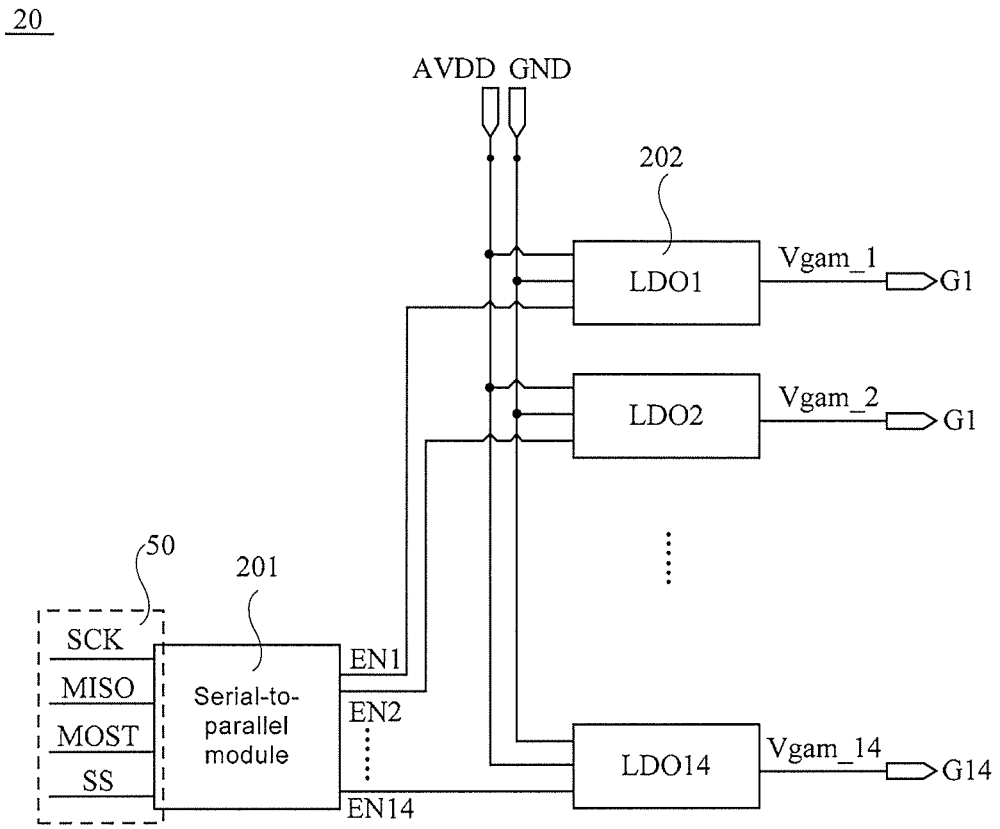
FIG. 5 is a schematic structure diagram of a grayscale controller in FIG. 1 or FIG. 2.

Based on this, since the plurality of reference grayscale voltage output terminals of the grayscale controller 20 need to be separately controlled by parallel data, in some embodiments of the present disclosure, as shown in FIG. 5, the grayscale controller 20 includes a serial-to-parallel module 201 and a plurality of grayscale voltage generation modules 202 (LDO).

The serial-to-parallel module 201 is connected to the serial interface 50. The serial-to-parallel module 201 is configured to convert serial data input from the serial interface 50 into a plurality of parallel data (e.g., 16-bit binary data), and output the plurality of parallel data to a plurality of enable signal output terminals (e.g., EN1, EN2 . . . EN14) of the serial-to-parallel module 201 respectively.

Based on this, each grayscale voltage generation module 202, such as LDO1, is connected to one enable signal output terminal, such as EN1, of the serial-to-parallel module 201. The grayscale voltage generation module 202 is configured to generate a reference grayscale voltage Vgam_1 according to preset parameters under the control of an enable signal output terminal such as EN1.

The data input to each enable signal output terminal is "0" or "1". At this time, when the enable signal output terminal, such as EN1, outputs "1" to a grayscale voltage generation module 202, such as LDO1, connected with the enable signal output terminal EN1, the grayscale voltage generation module 202, such as LDO1, may generate a reference grayscale voltage Vgam_1 according to the preset parameters, and output the reference grayscale voltage Vgam_1 to the source IC 30 through the reference grayscale voltage output terminal G1. That is, the output terminal of LDO1 in the grayscale voltage generation modules 202 is the reference grayscale voltage output terminal G1, the output terminal of LDO2 in the grayscale voltage generation modules 202 is the reference grayscale voltage output terminal G2 . . . and the output terminal of LDON in the grayscale voltage generation modules 202 is the reference grayscale voltage output terminal GN.

Alternatively, when the enable signal output terminal, such as EN1, outputs "0" to a grayscale voltage generation module 202, such as LDO1, connected with the enable signal output terminal EN1, the grayscale voltage generation module 202, such as LDO1, has no signal output, therefore LDO1 does not consume any power.

In this case, the embodiments provided by the present disclosure can save the power consumption of the grayscale controller 20 as compared with the solution in which all the grayscale voltage generation modules 202 output reference grayscale voltages. Based on this, since the grayscale controller 20 is usually fabricated on a Printed Circuit Board (PCB), the power consumption of the PCB may be reduced. In addition, as shown in FIG. 5, each grayscale voltage generation module 202 has an independent reference grayscale voltage output terminal, therefore the stability of reference grayscale voltages output from each reference grayscale voltage output terminal can be improved and mutual interference can be avoided.

It will be noted that, the magnitude of the reference grayscale voltage Vgam generated by each of the grayscale voltage generation modules 202 may be obtained by presetting the parameters inside the grayscale voltage generation module 202 in a programmed manner.

In addition, besides an enable signal output terminal of the serial-to-parallel module 201, each of the grayscale voltage generation modules 202 is also connected to a supply voltage terminal AVDD configured to provide an operating current to the grayscale voltage generation modules 202, and a ground terminal GND.

Next, take the structure of the grayscale controller 20 shown in FIG. 5 as an example, the working processes of the timing controller 10 and the grayscale controller 20 are illustrated in detail.

Example 1: Displaying a Frame of Pure Grayscale Image

For example, when a frame of display image to be displayed is a pure grayscale image, the grayscale values of a row of subpixels in the frame of display image acquired by the timing controller 10 are all the same, for example, a grayscale value L127. At this time, the timing controller 10 inputs serial grayscale data 0000011000001100 (i.e., hexadecimal number 060CH) to the grayscale controller 20 through the serial interface 50. The reference grayscale voltage output by each reference grayscale voltage output terminal can be set in advance so as to match with the grayscale value, which will not be described here. For example, the above-mentioned grayscale data 000001100001100 matches with the grayscale value L127.

In this case, after being converted by the serial-to-parallel module 201 in the grayscale controller 20, the first 14 bits (from right to left) of the 16-bit binary data are respectively input to 14 grayscale voltage generation modules 202 (LDO1, LDO2 . . . LDO14). At this time, only the LDO3, LDO4, LDO10 and LDO11 receive "1" from the enable signal output terminals EN3, EN4, EN10 and EN11 respectively, and the remaining grayscale voltage generation modules 202 receive "0". Therefore, LDO3, LDO4, LDO10 and LDO11 output reference grayscale voltages Vgam_3, Vgam_4, Vgam_10 and Vgam_11 through the reference grayscale voltage output terminals G3, G4, G10 and G11 respectively, and the remaining reference grayscale voltage output terminals are left unused and have no signal output. As a result, the source IC 30 receives less amount of data output from the grayscale controller 20, therefore the requirement for a computing power of the source IC 30 may be lowered, and the purpose of reducing the power consumption of the source IC 30 may be achieved.

As can be seen from the above, when a frame of display image to be displayed is a pure grayscale image, the source IC 30 only needs to receive 4 reference grayscale voltages Vgam. Therefore, the power consumption of the source IC 30 may be reduced by about 71.4% as compared with receiving 14 reference grayscale voltages Vgam.

Example 2: Displaying a Frame of Solid Color Image

Alternatively, for another example, when a frame of display image to be displayed is a solid color image, such as a red (R) image, in a row of subpixels in a frame of display image acquired by the timing controller 10, R pixels are bright (for example, the grayscale value is L127), and G and B pixels are black (the grayscale value is L0). At this time, the timing controller 10 inputs serial grayscale data 0000011011001100 (i.e., hexadecimal number 06CCH) to the grayscale controller 20 through the serial interface 50. The grayscale data 0000011011001100 matches with the R pixels with a grayscale value of L127 and the G and B pixels with a grayscale value of L0.

Similarly, only LDO3, LDO4, LDO7, LDO8, LDO10 and LDO11 receive "1" from the enable signal output terminals EN3, EN4, EN7, EN8, EN10 and EN11 respectively, and the remaining grayscale voltage generation modules 202 receive "0". Therefore, LDO3, LDO4, LDO7, LDO8, LDO10 and LDO11 output reference grayscale voltages Vgam_3, Vgam_4, Vgam_7, Vgam_8, Vgam_10 and Vgam_11 through the reference grayscale voltage output terminals G3, G4, G7, G8, G10 and G11 respectively, and the remaining reference grayscale voltage output terminals are left unused and have no signal output.

Example 3: Displaying a Frame of Full Grayscale Image

Alternatively, for yet another example, when a frame of display image to be displayed is a full grayscale image, the grayscale values of a row of subpixels in a frame of display image acquired by the timing controller 10 are different from each other, and are all in the grayscale value range of L0 to L255. At this time, the timing controller 10 inputs serial grayscale data 0011111111111111 (i.e., hexadecimal number 3FFFH) to the grayscale controller 20 through the serial interface 50. The grayscale data 0011111111111111 matches with all the grayscale values in the grayscale value range of L0~L255.

Similarly, at this time, 14 grayscale voltage generation modules 202 (LDO1, LDO2 . . . LDO14) in the grayscale controller 20 all receive "1", therefore the reference grayscale voltage output terminals (G1, G2 . . . G14) of each grayscale voltage generation module 202 output the reference grayscale voltages (Vgam_1, Vgam_2 . . . Vgam_14) respectively. However, even for a display image with complex colors, the probability that the grayscale values of a row of subpixels in each frame of display image match with all the grayscale values in the grayscale value range of L0 to L255 is low. Therefore, the power consumption of the source IC 30 can be effectively reduced by using the solution provided by embodiments of the present disclosure.

Based on this, the structure of the above-mentioned source IC 30 will be described.

As shown in FIG. 2, the source IC 30 includes a plurality of driving channels 301 that are in one-to-one correspondence with a plurality of data lines DL. Based on this, as shown in FIG. 4, a digital-to-analog converter 3011 and an operational amplifier 3012 are disposed in each driving channel 301.

Each digital-to-analog converter 3011 is connected to the plurality of reference grayscale voltage output terminals (e.g., G1, G2 . . . G14) of the grayscale controller 20. The digital-to-analog converter 3011 is configured to generate at least one grayscale voltage according to the reference grayscale voltages (e.g., Vgam1, Vgam2 . . . Vgam14) output by the plurality of reference grayscale voltage output terminals (e.g., G1, G2 . . . G14), and the at least one grayscale voltage is an analog voltage. Although the digital-to-analog converter 3011 is configured to have the capability of generating at least one grayscale voltage, only one grayscale voltage is generated corresponding to one data line at a specific time.

In addition, an input terminal of the operational amplifier (OP) 3012 is connected to the digital-to-analog converter 3011, and an output terminal (OUTPUT) of the operational amplifier 3012 is connected to a corresponding data line DL. The operational amplifier 3012 is configured to amplify the analog voltage output from the digital-to-analog converter 3011 and output the analog voltage as a data voltage (Vdata) to the corresponding data line DL.

Figure 6:
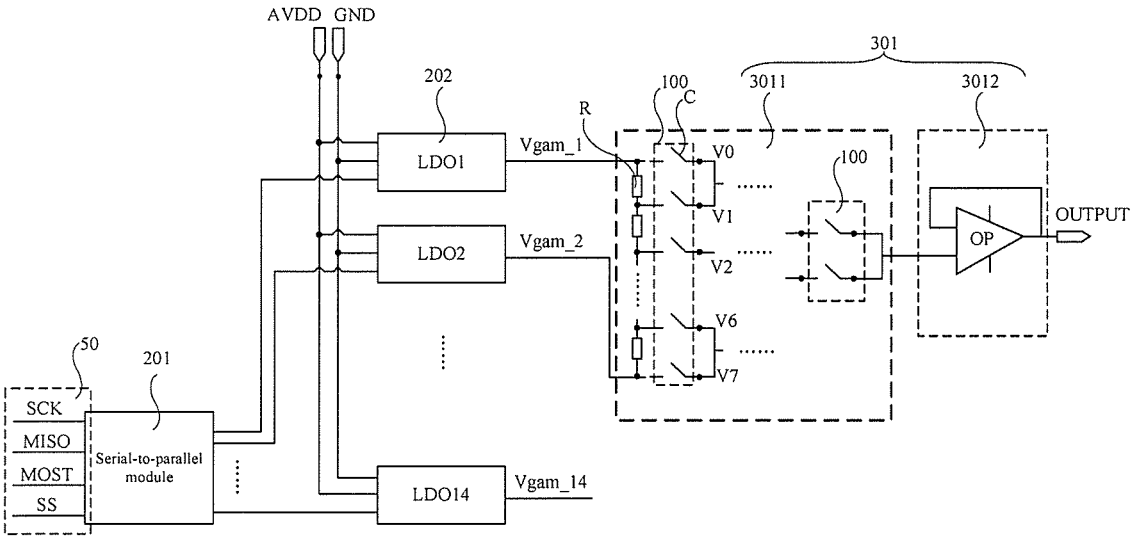
FIG. 6 is a schematic structure diagram of a source IC in FIG. 1 or FIG. 2.

In some embodiments of the present disclosure, as shown in FIG. 6, the digital-to-analog converter 3011 includes a plurality of voltage-dividing resistors R connected in series and a plurality of control switch groups 100 that are cascaded and connected to the voltage-dividing resistors R. Each control switch group 100 includes a plurality of control switches C connected in parallel.

Each control switch C is connected with the timing controller 10. In this case, the timing signal output by the timing controller 10 can control an on and off of the control switch C. Exemplarily, the timing signal input by the timing controller 10 to the control switch C is a digital signal (6-bit or 8-bit), and each binary bit "0" or "1" in the digital signal may control the on or off of each control switch C, so that a turned on control switch C can output a divided voltage connected to the control switch C, thereby converting the digital signal to an analog signal.

It will be noted that the number of voltage-dividing resistors between two adjacent reference grayscale output terminals, for example, the reference grayscale voltage output terminals G1 and G2 for outputting the reference grayscale voltages Vgam_1 and Vgam_2, may be set with reference to a Gamma curve.

For example, when the above-mentioned timing controller 10 inputs a 6-bit digital signal to the source IC 30, each driving channel 301 can output 64 ($2^6$, 2 to the 6th power) grayscale voltages.

Figure 7:
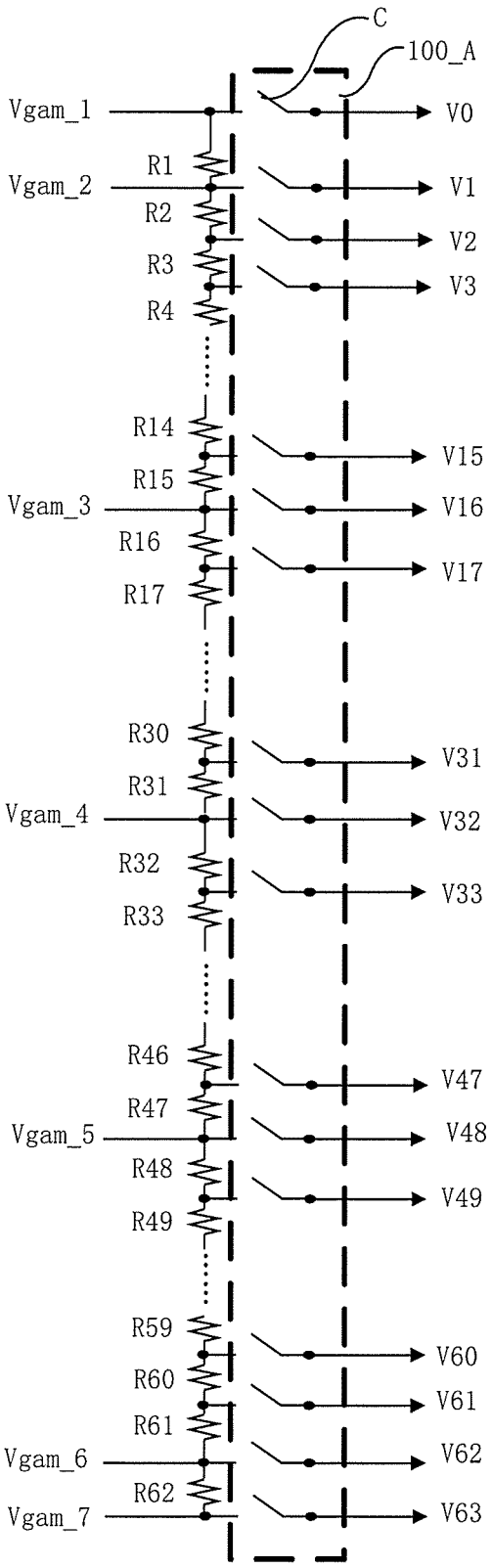
FIG. 7 is a schematic diagram of a connection structure of a part of voltage-dividing resistors of a digital-to-analog converter in FIG. 6.

FIG. 7 shows a connection relationship between the reference grayscale voltage output terminals (e.g., G1, G2 . . . G7) capable of outputting positive-polarity reference grayscale voltages (e.g., Vgam_1, Vgam_2 . . . Vgam_7) and a plurality of voltage-dividing resistors R.

Figure 8:
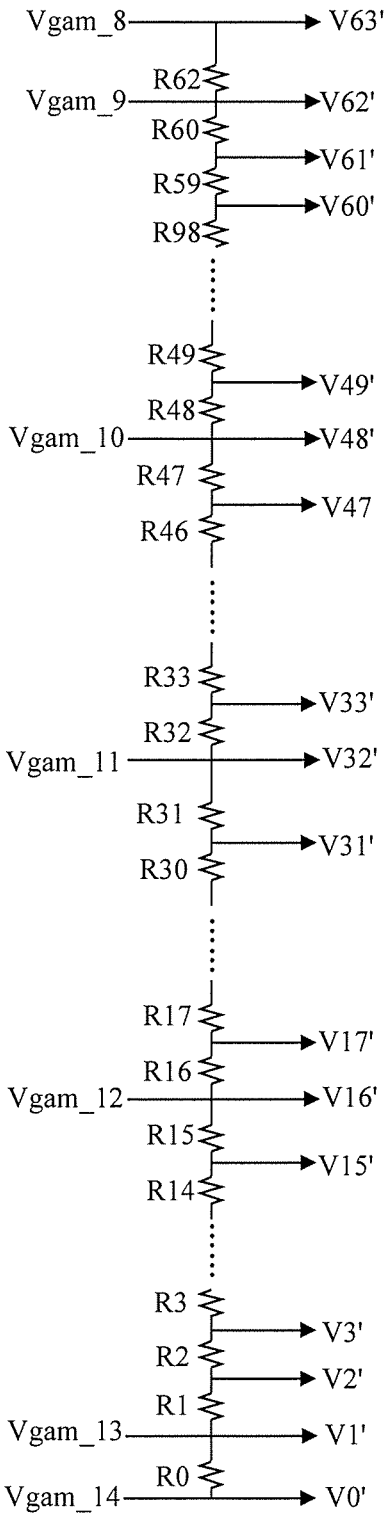
FIG. 8 is a schematic diagram of a connection structure of another part of voltage-dividing resistors of a digital-to-analog converter in FIG. 6.

FIG. 8 shows a connection relationship between the reference grayscale voltage output terminals (e.g., G8, G9 . . . G14) capable of outputting negative-polarity reference grayscale voltages (e.g., Vgam_8, Vgam_9 . . . Vgam_14) and a plurality of voltage-dividing resistors R. It can be seen that as the Gamma curve is a non-linear curve, the distribution of the number of voltage-dividing resistors R between any two adjacent reference grayscale voltage output terminals is non-linear.

In some embodiments of the present disclosure, as shown in FIG. 7, there is a voltage-dividing resistor R1 between Vgam_1 and Vgam_2, so that one grayscale voltage can be output; and there are 14 voltage-dividing resistors R between Vgam_2 and Vgam_3, so that 15 grayscale voltages can be output. With reference to FIG. 7 and FIG. 8, it can be seen that the reference grayscale voltage output terminals (e.g., G1, G2 . . . G7) can output 64 grayscale voltages, so that each of the above-mentioned driving channels 301 can have 64 grayscale levels.

Similarly, when the timing controller 10 inputs 8-bit digital signals to the source IC 30 and each driving channel 301 can output 256 (($2^8$, 2 to the 8th power) grayscale voltages, there are a total of 256 voltage-dividing resistors connected to the reference grayscale voltage output terminals (e.g., G1, G2 . . . G7).

Based on this, take it as an example that the timing controller 10 inputs 6-bit digital signals to the source IC 30, seven levels of control switch groups 100 is disposed in each driving channel 301.

As shown in FIG. 7, a first-level control switch group 100_A has 64 control switches C connected in parallel, and each control switch C is configured to output a grayscale voltage. In this case, the first-level control switch group 100_A may output (V0 to V63) a total of 64 grayscale voltages.

A second-level control switch group has a total of 32 control switches C connected in parallel for selecting 32 grayscale voltages from the 64 grayscale voltages of the first-level control switch group.

A third-level control switch group has a total of 16 control switches C connected in parallel, which are configured to select 16 grayscale voltages from the 32 grayscale voltages of the second-level control switch group.

The fourth-level control switch group has a total of 8 control switches C connected in parallel, which are configured to select 8 grayscale voltages from the 16 grayscale voltages of the third-level control switch group.

The fifth-level control switch group has a total of 4 control switches C connected in parallel, which are configured to select 4 grayscale voltages from the 8 grayscale voltages of the fourth-level control switch group.

The sixth-level control switch group has a total of 2 control switches C connected in parallel, which are configured to select 2 grayscale voltages from the 4 grayscale voltages of the fifth-level control switch group;

The seventh-level control switch group has 1 control switch C, which is configured to select 1 grayscale voltage from the 2 grayscale voltages of the sixth-level control switch group.

The finally selected grayscale voltage will be input to the data line DL as a data voltage (Vdata) in the form of an analog voltage.

Of course, when the timing controller 10 inputs 8-bit digital signals to the source IC 30, each driving channel 301 can output 256 grayscale voltages, and the first-level control switch group of the plurality of control switch groups that are cascaded has 256 control switches connected in parallel. Each control switch is configured to output a grayscale voltage, and the remaining levels of control switch groups are set as described above, which will not be repeated here.

In this case, the digital-to-analog conversion module 3011 in each drive channel 301 is connected with all of the plurality of reference grayscale voltage output terminals (e.g., G1, G2 . . . G14) of the grayscale controller 20. The digital signal output from the timing controller 10 to the source IC 30 can control the on and off of part of the control switches in the digital-to-analog conversion module 3011 of the source IC 30, so that the grayscale voltage matched with the data line DL corresponding to the driving channel 301 can be output to the data line DL as an analog voltage.

As can be seen from the above, of the plurality of reference grayscale voltage output terminals of the grayscale controller 20, generally only a few reference grayscale voltage output terminals output reference grayscale voltages, therefore in the digital-to-analog converter 3011, the voltage-dividing resistors connected to the reference grayscale voltage output terminals having no signal output do not need to perform a voltage division operation. As a result, no power consumption is required, and the purpose of reducing the power consumption of the source IC 30 is achieved.

Some embodiments of the present disclosure provide a display device including any of the display driving circuits described above. A plurality of data lines DL are provided in a display area of the display device, and the plurality of data lines DL are connected to the source IC 30. The display device has the same structure and advantageous effects as the display driving circuit provided by the foregoing embodiments, which will not be described herein.

It will be noted that, the display device includes a display panel, and the source IC 30 may be integrated in a non-display area of the display panel. The image processor 40, the timing controller 10, and the grayscale controller 20 may be fabricated on a PCB connected to the display panel.

In addition, the above display device may be any product or component having a display function such as a liquid crystal display, a liquid crystal television, a digital photo frame, a mobile phone or a tablet computer.

Figure 9:
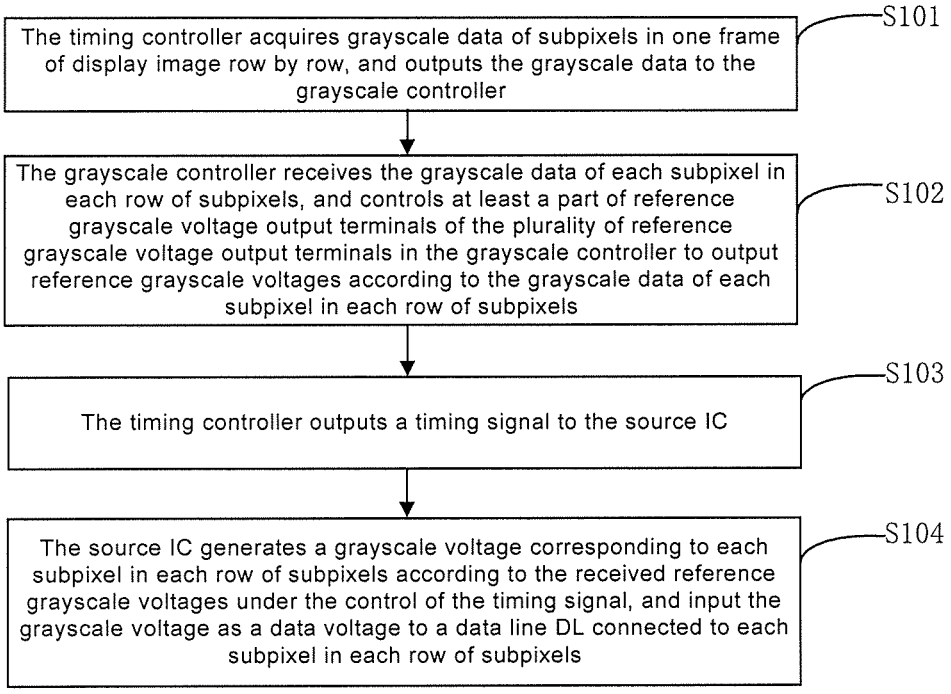
FIG. 9 is a flowchart of a method of driving a display driving circuit provided by some embodiments of the present disclosure.

Some embodiments of the present disclosure provide a method for driving any one of the display driving circuits described above. As shown in FIG. 9, the method includes S101 to S104.

S101: The timing controller 10 as shown in FIG. 1 acquires grayscale data of subpixels in a frame of display image row by row, and outputs the grayscale data to the grayscale controller 20.

S102: The grayscale controller 20 receives the grayscale data of each subpixel in each row of subpixels, and controls at least a part of reference grayscale voltage output terminals (G1, G2, G3 . . . GN) of the plurality of reference grayscale voltage output terminals in the grayscale controller to output reference grayscale voltages (Vgam_1, Vgam_2, Vgam_3 . . . Vgam_N) according to the grayscale data of each subpixel in each row of subpixels.

S103: The timing controller 10 outputs a timing signal to the source IC 30.

S104: The source IC 30 generates a grayscale voltage corresponding to each subpixel in each row of subpixels according to the received reference grayscale voltages (Vgam_1, Vgam_2, Vgam_3 . . . Vgam_N) under the control of the timing signal, and inputs the grayscale voltage as a data voltage (Vdata) to a data line DL connected to each subpixel in each row of subpixels.

It will be noted that the advantageous effects of the above method for driving a display driving circuit are the same as the advantageous effects of the display driving circuit, and will not be repeated here.

Based on this, in the case where the timing controller 10 is connected to the grayscale controller 20 through the serial interface 50, and the grayscale controller 20, as shown in FIG. 5, includes a serial-to-parallel module 201 and a plurality of grayscale voltage generation modules 202, the above step 102 includes:

First, the serial-to-parallel module 201 converts serial data input from the serial interface 50 into a plurality of parallel data (e.g., 16-bit binary data), and outputs the plurality of parallel data to a plurality of enable signal output terminals (e.g., EN1, EN2 . . . EN14) of the serial-to-parallel module 201 respectively.

Next, the grayscale voltage generation modules 202 generate reference grayscale voltages (Vgam_1, Vgam_2 . . . Vgam_14) according to preset parameters under the control of the enable signal output terminals (e.g., EN1, EN2 . . . EN14).

Take it as an example that the grayscale controller 20 has 14 reference grayscale voltage output terminals (G1, G2, G3, G4, G5, G6, G7, G8, G9, G10, G11, G12, G13, G14), the on and off combinations of the 14 reference grayscale voltage output terminals are the same as described above, and will not be repeated here.

Since the probability is low that the grayscale values of a row of subpixels in each frame of display image are all in the range of L0~L255 and different from each other, the plurality of reference grayscale voltage output terminals (e.g., G1, G2 . . . G14) of the grayscale controller 20 are not all outputting reference grayscale voltages in real time. Therefore, the reference grayscale voltage output terminals with no output are left unused. As a result, the source IC 30 receives less amount of data output from the grayscale controller 20, therefore the requirement for a computing power of the source IC 30 may be lowered, and the purpose of reducing a power consumption of the source IC 30 may be achieved.

Based on this, in the case where the source IC 30 includes a plurality of driving channels 301 that are in one-to-one correspondence with a plurality of data lines DL, and a digital-to-analog converter 3011 and an operational amplifier 3012 as shown in FIG. 6 are disposed in each driving channel 301, the above step 104 includes:

First, the digital-to-analog converter 3011 generates at least one grayscale voltage according to the reference grayscale voltages output by the reference grayscale voltage output terminals; the at least one grayscale voltage is an analog voltage.

In the case where the structure of the digital-to-analog converter 3011 is as shown in FIG. 6, the working process of the digital-to-analog converter 3011 is the same as described above, and will not be repeated here.

Then, the operational amplifier 3012 amplifies the analog voltage output from the digital-to-analog converter 3011 to use as a data voltage (Vdata).

As can be seen the above, of the plurality of reference grayscale voltage output terminals of the grayscale controller 20, generally only a few reference grayscale voltage output terminals output reference grayscale voltages, therefore in the digital-to-analog converter 3011, the voltage-dividing resistors connected to the reference grayscale voltage output terminals having no signal output do not need to perform a voltage division operation. As a result, no power consumption is required, and the purpose of reducing the power consumption of the source IC 30 is achieved.

The steps of the methods or algorithms described in the embodiments of the present disclosure may be implemented by executing software instructions. The software instructions may consist of corresponding software modules. The software modules may be stored in random access memory (RAM), flash memory, read only memory (ROM), erasable programmable read-only memory (EPROM), electrically EPROM (EEPROM), a register, a hard disk, a removable hard disk, a CD-ROM, or any other form of storage medium known in the art.

Therefore, some embodiments of the present disclosure also provide a computer non-transitory readable storage medium. The computer non-transitory readable storage medium stores computer instructions, and the computer instructions are configured to perform a method of driving the display driving circuit.

Some embodiments of the present disclosure also provide a computer program product. The computer program product comprises instructions that, when run on a computer, cause a computer to perform a method of driving the display driving circuit.

Some embodiments of the present disclosure provide a computer program. When loaded onto a processor, the computer program causes the processor to perform a method of driving the display driving circuit.

Those skilled in the art should appreciate that in one or more of the above examples, the functions described herein may be implemented in hardware, software, firmware, or any combination thereof. When implemented in software, these functions may be stored in a computer-readable medium or be transmitted as one or more instructions or codes in a computer-readable medium. The computer-readable medium includes a computer storage medium and a communications medium, wherein the communications medium includes any medium that facilitates transfer of a computer program from one place to another. The storage medium may be any available medium that can be accessed by a general-purpose or special-purpose computer.

The foregoing descriptions are merely some specific implementation manners of the present disclosure, but the protection scope of the present disclosure is not limited thereto, and the changes or replacements that any person skilled in the art can easily think of in the technical scope disclosed by the present disclosure should be within the protection scope of the present disclosure. Therefore, the protection scope of the present disclosure shall be subject to the protection scope of the claims.

What is claimed is:

1. A display driving circuit, comprising a timing controller, a grayscale controller and a source IC, wherein;

the timing controller is connected with the grayscale controller and the source IC, and the timing controller is configured to acquire grayscale data of subpixels in a frame of display image row by row and output the grayscale data to the grayscale controller; the timing controller is also configured to output a timing signal to the source IC;

the grayscale controller has a plurality of reference grayscale voltage output terminals corresponding to each subpixel in each row of subpixels; the grayscale controller is configured to receive grayscale data of each row of subpixels row by row, and control at least a part of reference grayscale voltage output terminals of the plurality of reference grayscale voltage output terminals in the grayscale controller to output reference grayscale voltages according to the grayscale data of each subpixel in each row of subpixels;

the source IC is also connected with the plurality of reference grayscale voltage output terminals; the source IC is configured to generate a grayscale voltage corresponding to each subpixel in each row of subpixels according to the received reference grayscale voltages under the control of the timing signal, and input the grayscale voltage as a data voltage to a data line connected to each subpixel in each row of subpixels;

the timing controller is connected to the grayscale controller through a serial interface; the grayscale controller comprises a serial-to-parallel module and a plurality of grayscale voltage generation modules;

the serial-to-parallel module is connected to the serial interface, and the serial-to-parallel module is configured to convert serial data input from the serial interface into a plurality of parallel data and output the plurality of parallel data to a plurality of enable signal output terminals of the serial-to-parallel module respectively;

each of the grayscale voltage generation modules is connected to one enable signal output terminal of the serial-to-parallel module; each of the grayscale voltage generation modules is configured to generate a reference grayscale voltage according to preset parameters under the control of one enable signal output terminal of the plurality of enable signal output terminals.

2. The display driving circuit according to claim 1, wherein the grayscale data is composed of multi-bit binary numbers, and each bit of the multi-bit binary numbers corresponds to one reference grayscale voltage output terminal of the plurality of reference grayscale voltage output terminals, so as to make the one reference grayscale voltage output terminal output or stop outputting a reference grayscale voltage to the source IC.

3. The display driving circuit according to claim 1, wherein the grayscale controller comprises multiple sets of reference grayscale voltage output terminals;

each set of reference grayscale voltage output terminals of the multiple sets of reference grayscale voltage output terminals comprises the plurality of reference grayscale voltage output terminals; and each set of reference grayscale voltage output terminals corresponds to a column of sub pixels.

4. The display driving circuit according to claim 1, wherein the grayscale controller comprises:

a set of reference grayscale voltage output terminals, wherein the set of reference grayscale voltage output terminals comprises the plurality of reference grayscale voltage output terminals;

multiple sets of access switches, wherein each set of access switches of the multiple sets of access switches corresponds to a column of subpixels, and each set of access switches comprises a plurality of access switches, and each access switch of the plurality of access switches is connected to the plurality of reference grayscale voltage output terminals in one-to-one correspondence.

5. The display driving circuit according to claim 1, wherein an output terminal of each of the grayscale voltage generation modules is formed as one reference grayscale voltage output terminal.

6. The display driving circuit according to claim 1, wherein the source IC comprises a plurality of driving channels that are in one-to-one correspondence with a plurality of data lines, and a digital-to-analog converter and an operational amplifier are disposed in each driving channel;

the digital-to-analog converter is connected with the plurality of reference grayscale voltage output terminals of the grayscale controller, and the digital-to-analog converter is configured to be able to generate at least one grayscale voltage according to the reference grayscale voltages output by the plurality of reference grayscale voltage output terminals; the at least one grayscale voltage is an analog voltage;

the operational amplifier is connected with the digital-to-analog converter and a data line, and the operational amplifier is configured to amplify the analog voltage output by the digital-to-analog converter so as to output the analog voltage as a data voltage to the data line.

7. The display driving circuit according to claim 6, wherein the digital-to-analog converter is configured to have the capability of generating at least one grayscale voltage, and generate only one grayscale voltage corresponding to one data line at a specific time.

8. The display driving circuit according to claim 6, wherein the digital-to-analog converter comprises a plurality of voltage-dividing resistors connected in series and a plurality of control switch groups that are cascaded and connected with the voltage-dividing resistors; each control switch group comprises a plurality of control switches connected in parallel;

each of the control switches is connected to the timing controller, and the timing controller is configured to control an on and off of each of the control switches.

9. The display driving circuit according to claim 1, wherein a part of reference grayscale voltage output terminals of the plurality of reference grayscale voltage output terminals are located in a first output terminal group, and another part of the reference grayscale voltage output terminals are located in a second output terminal group;

the reference grayscale voltages output by the reference grayscale voltage output terminals in the first output terminal group have a positive polarity;

the reference grayscale voltages output by the reference grayscale voltage output terminals in the second output terminal group have a negative polarity;

wherein, the numbers of reference grayscale voltage output terminals in the first output terminal group and in the second output terminal group are equal.

10. The display driving circuit according to claim 1, further comprising an image processor connected to the timing controller; the image processor is configured to store multiple successive frames of display images.

11. The display driving circuit according to claim 10, wherein the image processor is further configured to output the grayscale data of each subpixel in each frame of display image to the timing controller one by one.

12. A display device comprising the display driving circuit according to claim 1, wherein, a plurality of data lines are disposed in a display area of the display device, and each of the data lines is connected to the source IC.

13. A method for driving the display driving circuit according to claim 1, wherein the method comprises:

the timing controller acquiring the grayscale data of the subpixels in one frame of display image row by row and outputting the grayscale data to the grayscale controller;

the grayscale controller receiving the grayscale data of each subpixel in each row of subpixels, and controlling at least a part of reference grayscale voltage output terminals of the plurality of reference grayscale voltage output terminals in the grayscale controller to output reference grayscale voltages according to the grayscale data of each subpixel in each row of subpixels;

the timing controller outputting a timing signal to the source IC;

the source IC generating a grayscale voltage corresponding to each subpixel in each row of subpixels according to the received reference grayscale voltages under the control of the timing signal, and inputting the grayscale voltage as a data voltage to a data line connected to each subpixel in each row of subpixels;

wherein, in the case where the timing controller is connected to the grayscale controller through a serial interface, and the grayscale controller comprises a serial-to-parallel module and a plurality of grayscale voltage generation modules, the grayscale controller controlling at least a part of reference grayscale voltage output terminals of the plurality of reference grayscale voltage output terminals in the grayscale controller to output reference grayscale voltages according to the grayscale data of each subpixel in each row of subpixels comprises:

the serial-to-parallel module converting serial data input from the serial interface into a plurality of parallel data and outputting the plurality of parallel data to a plurality of enable signal output terminals of the serial-to-parallel module respectively, the grayscale voltage generation modules generating a reference grayscale voltage according to preset parameters under the control of the enable signal output terminal.

14. The method according to claim 13, wherein, in the case where the source IC comprises a plurality of driving channels that are in one-to-one correspondence with a plurality of data lines, and a digital-to-analog converter and an operational amplifier are disposed in each driving channel, the source IC generating a grayscale voltage corresponding to each subpixel in each row of subpixels according to the received reference grayscale voltages, and inputting the grayscale voltage as a data voltage to a data line connected to each subpixel in each row of subpixels under the control of the timing signal comprises:

the digital-to-analog converter generating at least one grayscale voltage according to the reference grayscale voltages output by the reference grayscale voltage output terminals; the at least one grayscale voltage is an analog voltage;

the operational amplifier amplifying the analog voltage output by the digital-to-analog converter so as to output the analog voltage as a data voltage to the data line.

* * * * *